US005947182A

United States Patent [19]

Nohara et al.

[11] Patent Number: 5,947,182

[45] Date of Patent: Sep. 7, 1999

[54] SYSTEM FOR PRODUCING CONTINUOUSLY METALLIC COIL

[75] Inventors: Yoshikatsu Nohara; Shunji Shoda, both of Futtsu, Japan

[73] Assignee: Nippon Steel Corporation, Tokyo, Japan

[21] Appl. No.: 09/197,339

[22] Filed: Nov. 19, 1998

Related U.S. Application Data

[63] Continuation of application No. 08/776,076, filed as application No. PCT/JP96/01211, May 7, 1996, Pat. No. 5,875,831.

[30] Foreign Application Priority Data

May 8, 1995 [JP] Japan ..... 7-109470

[51] Int. Cl.[6] ..... B22D 11/12; B21B 1/46

[52] U.S. Cl. ..... 164/417; 164/423; 164/415; 29/33 R

[58] Field of Search ..... 164/417, 423, 164/415, 477, 66.1, 480, 485; 29/33 R, 527.7

[56] References Cited

U.S. PATENT DOCUMENTS

| | | | |
|---|---|---|---|
| 4,579,169 | 4/1986 | Bradley et al. | 164/432 |
| 5,307,864 | 5/1994 | Arvedi et al. | 164/476 |
| 5,875,831 | 3/1999 | Nohara et al. | 164/477 |

FOREIGN PATENT DOCUMENTS

| | | |
|---|---|---|
| 60-238002 | 11/1985 | Japan . |
| 61-206506 | 9/1986 | Japan . |
| 62-77159 | 4/1987 | Japan . |
| 63-224846 | 9/1988 | Japan . |
| 2-113528 | 5/1990 | Japan . |
| 4-200801 | 7/1992 | Japan . |
| 5-57405 | 3/1993 | Japan . |
| 7-331330 | 12/1995 | Japan . |
| 1071650 | 2/1984 | U.S.S.R. . |
| WO-102706 | 1/1995 | WIPO . |

*Primary Examiner*—Harold Pyon
*Assistant Examiner*—I.-H. Lin
*Attorney, Agent, or Firm*—Kenyon & Kenyon

[57] ABSTRACT

A metallic coil production system by providing a cooler downstream of a heat-treating furnace in a line of continuous casting of a thin strip-like slab, hot rolling, and heat treatment and providing, downstream of the cooler, a pickling device, a trimmer, a heat-treating device, a shear, and a coiler. The apparatus is constructed so that a pickling line, a trimmer line, and a shear line after the line of continuous casting of a thin strip-like slab, hot rolling, and heat treatment can be switched, permitting the lines to be operated in a continuous or discontinuous (independent) manner.

5 Claims, 7 Drawing Sheets

SYSTEM FOR PRODUCING CONTINUOUSLY METALLIC COIL

This application is a continuation application under 37 C.F.R. §1.53(b) of prior application Ser. No. 08/776,076 filed Feb. 14, 1997 and now issued as U.S. Pat. No. 5,875,831 which was a 35 U.S.C. §371 of PCT/JP96/01211 having an international filing date of May 7, 1996.

TECHNICAL FIELD

The present invention relates to an apparatus for producing continuously a metallic coil and a metallic coil production process, wherein a common steel, a stainless steel, an electromagnetic steel or the like is continuously cast at a high speed, for example, by a twin-roll type continuous casting machine, into a thin strip-like slab which is then continuously hot-rolled and heat-treated at a high temperature and a high speed and cooled and optionally pickled and trimmed to produce a strip of the above steel.

BACKGROUND ART

In recent years, in the field of iron and steel, for example, a process of continuous casting a thin strip-like slab, hot rolling and heat treating using a device for continuously casting a thin strip-like slab, a hot rolling machine, a heat-treating furnace and the like provided in sequence has been adopted for the production of steel strips from the viewpoint of improving the productivity by the elimination of steps, reduction in cost of installation and basic cost of fuel and the like.

The development of a twin-roll type continuous casting method using two rolls, as disclosed, for example, in Japanese Unexamined Patent Publication (Kokai) No. 63-224846, has led to the practical use of the process of continuous casting/hot rolling/heat treating. In the process of continuous casting of a thin strip-like slab/hot rolling/heat treating process, for example, a molten steel is poured into between two rolls and directly cast in a continuous manner into a thin strip-like slab having a thickness of 2 to 6 mm, and the thin strip-like slab is hot-rolled and heat-treated to prepare a strip which is then coiled by means of a coiler to prepare a coiled, hot-rolled coil.

An iron oxide scale is generally present on the surface of the hot-rolled coil prepared by the above process, and the shape of both side edge portions of the coil is uneven. For this reason, before machining the hot-rolled strip, the strip should be treated by using a pickling device for removing the scale and a trimmer for trimming both side edge portions of the strip.

A conventional method used for this purpose comprises passing a coiled, hot-rolled coil, having a thickness of 2 to 6 mm, through a pickling device provided in a separate line to remove a scale present on the surface of the coil, cold-rolling the pickled strip to a thickness of 0.2 to 3 mm and coiling the cold-rolled strip to deliver the strip as a cold-rolled coil. In the production of a cold-rolled coil by the above conventional method, however, two steps, i.e., pickling and cold rolling, should be additionally provided in a separate line, posing problems such as increased cost of installation and basic cost of heat, lowered productivity and the like.

As described above, in recent years, the practical use of the twin-roll type continuous casting method has made it possible to continuously cast a thin strip-like slab having a thickness of 2 to 6 mm which is then hot-rolled to a strip having a thickness of not more than 2 mm. This has enabled the step of cold rolling to be eliminated. Since, however, hot rolling increases the surface area of the strip, there is an ever-increasing demand for an improvement in efficiency of the steps of pickling and trimming.

On the other hand, when the step of pickling and the step of trimming are provided in series with the continuous casting/hot rolling/heat treatment process, the whole line must be ceased (or stopped) for repair or maintenance in any one step or for other reasons, resulting in lowered productivity. For this reason, it is necessary to construct the production apparatus in such a manner that the process of continuous casting of a thin strip-like slab/hot rolling/heat treatment and the steps of pickling and trimming can be performed separately from each other.

An object of the present invention is to provide an apparatus which can efficiently produce a product, corresponding to a cold-rolled product, from a continuously cast, thin, strip-like slab.

Another object of the present invention is to provide a production apparatus which, in the production of a product corresponding to a cold-rolled product, from the thin strip-like slab, enables a reduction in production cost, shortening of the period for delivery, reduction in quantity of material in progress between steps and the like.

A further object of the present invention is to provide a production apparatus which has the step of pickling and the step of trimming provided in a process of continuous casting of a thin strip-like slab/hot rolling/heat treatment so as to be operated in rapid response to the change of steps.

A yet further object of the present invention is to provide a process for producing a steel product, corresponding to a cold-rolled product, from the above thin strip-like slab.

DISCLOSURE OF THE INVENTION

In order to advantageously attain the above objects, the present invention provides an apparatus having the following construction and a process for producing the above steel product, corresponding to a cold-rolled product, using this apparatus.

Specifically, according to the present invention, there is provided an apparatus for continuously producing a metallic coil from a thin strip-like slab, comprising:

a device for continuously casting a thin strip-like slab and a hot rolling machine for hot-rolling the thin strip-like slab prepared by the device; a heat-treating furnace for heat-treating the hot-rolled strip; a cooler for cooling the strip heat-treated in the heat-treating furnace; a pickling device for pickling the cooled strip; and a trimmer for trimming both side edge portions of the pickled strip and a coiler for coiling the strip with the end portion of both side edge portions thereof being trimmed, said devices being arranged in sequence.

Arrangement of the above devices in sequence enables a product, corresponding to a cold-rolled product, to be produced from a thin strip-like slab with very high efficiency.

Further, the present invention may be constructed so that a vertical carrying device for carrying the strip cooled in the cooler with the carrier direction of the strip switched to the vertical direction is provided on the outlet side of the above cooler, a coiler having two take-up reels serving both as a coiler and an uncoiler is provided in proximity to the vertical carrying device, and a pickling line, provided continuously from the vertical carrying device, of a pickling device, a trimmer, a shear, and a coiler, a shear line wherein a cooled strip is introduced, through carrier rolls provided separately on the outlet side of the cooler, into pinch rolls provided before the shear, passed through the shear, and coiled, and a trimmer line wherein the cooled strip is introduced, through further extended carrier rolls, into pinch rolls provided before the trimmer, passed through the trimmer and the shear and then coiled, are provided, thus enabling the apparatus to be operated while selecting a desired line.

Further, in the above apparatus, during suspension of the pickling line, the heat-treated strip can be directly coiled and, upon resumption of the pickling line, uncoiled, introduced into the pickling line, passed through pickling, a trimmer, and a shear and then coiled.

Since the above apparatus can be operated while switching the lines, there is no need to stop the whole series of lines for repair or maintenance in each step, preventing a lowering in productivity and, at the same time, suppressing an increase in the quantity of coil in process and the stock of coil.

Further, a line can be selected according to various requirements for the coil, enabling a desired coil to be easily produced.

Furthermore, a reduction in cost associated with the step of pickling and the step of trimming and shortening of the period for delivery can be achieved without the provision of a welder and a looper.

Furthermore, the present invention can provide the following production process using the above production apparatus.

Specifically, a thin strip-like slab having a thickness of not more than 6 mm is produced by means of a continuous casting machine, and the thin strip-like slab is hot-rolled with a reduction ratio of not less than 30% to form a hot-rolled strip. Then, the hot-rolled strip is heat-treated in the temperature range of from 800 to 1250° C. and cooled at a rate of 20 to 40° C./sec from a cooling initiation temperature around 1000° C. to a temperature of 100° C. or below. The cooled strip is pickled, passed through a trimmer to trim both side edge portions of the strip, and coiled to form a pickled coil.

In the present invention, after the heat-treated strip is cooled, a pickling line wherein the strip is passed through a pickling device, a trimmer, and a shear and then coiled, a trimmer line wherein the strip is passed through a shear and then coiled, or a shear line wherein the strip is passed through a shear and then coiled, may be selected to produce a pickled coil or a hot-rolled coil.

BEST MODE FOR CARRYING OUT THE INVENTION

The best mode for carrying out the present invention will now be described with reference to the accompanying drawings.

At the outset, a system shown in FIG. 1 will be described.

Figure 1:
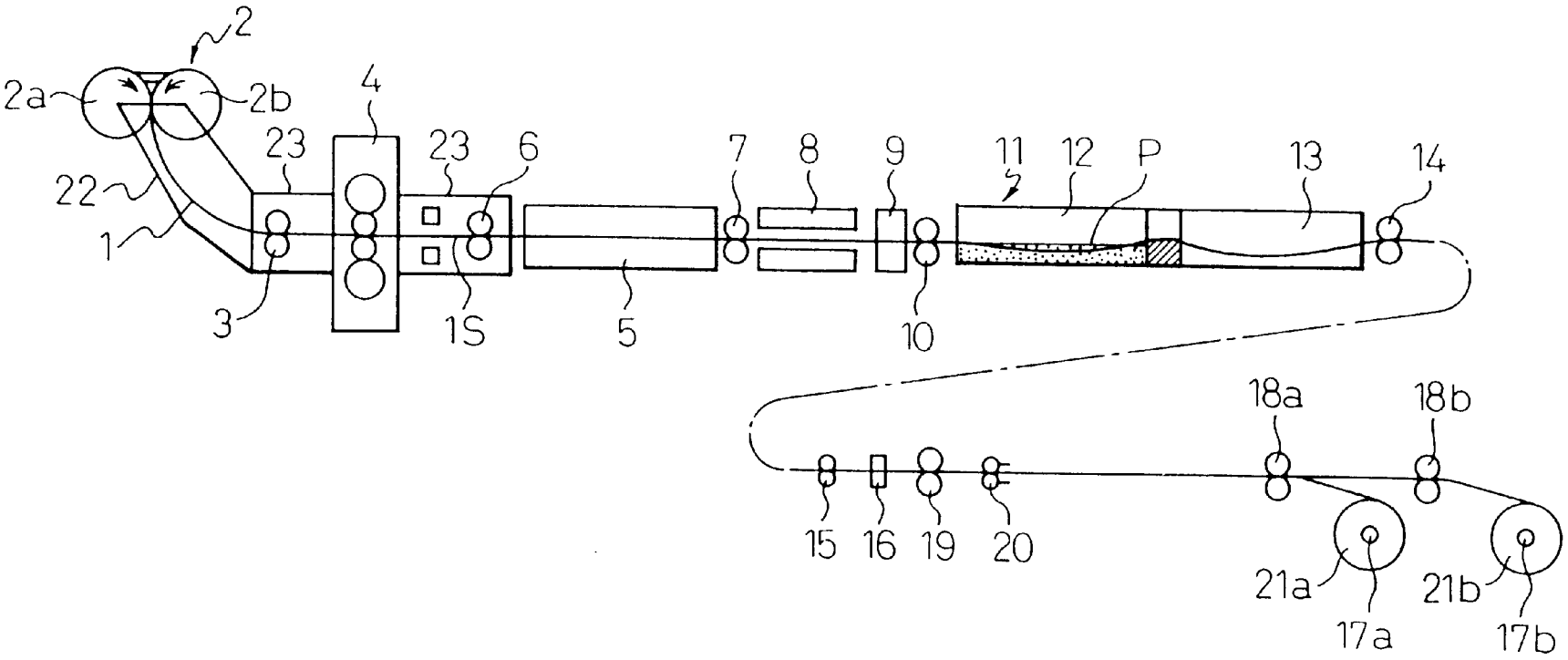
FIG. 1 is a schematic typical front view showing the apparatus for continuously casting a metallic coil according to one embodiment of the present invention.

In the apparatus shown in FIG. 1, a hot rolling machine is provided in proximity to a twin-roll type continuous casting machine, a cooler is provided on the outlet side of the hot-rolling machine, and a pickling device, a side trimmer, and a coiler are provided on the outlet side of the cooler.

Specifically, in FIG. 1, a thin strip-like slab 1 which has been continuously cast by means of a twin roll 2*a*, 2*b* of a twin-roll type continuous casting machine 2 is fed by means of pinch rolls 3 into a hot rolling machine 4 where the thin strip-like slab is hot-rolled to a strip 1S which is then introduced into a heat-treating furnace 5. Pinch rolls 6 and pinch rolls 7 are provided respectively on the inlet side and the outlet side of the heat-treating furnace, and the tension of the strip within the heat-treating furnace is controlled by means of the pinch rolls 6 on the inlet side and the pinch rolls 7 on the outlet side of the heat-treating furnace.

A cooler 8 is provided downstream of the heat-treating furnace to cool the strip 1S at 800 to 1250° C., discharged from the heat-treating furnace 5, to a temperature of about 100° C. In order to achieve rapid cooling at a rate of not less than 40° C./sec, the cooler 8 is provided with a slit nozzle.

A mechanical descaling device 9 (for example, a shot blasting device) is provided downstream of the cooler 8 to remove the scale present on the surface of the strip, thereby improving the pickling efficiency in a pickling device which will be described later. A pickling device 11 is provided downstream of the descaling device 9 through pinch rolls 10 on the inlet side of the pickling device. A heat exchanger (not shown) for preventing a temperature rise of the pickling solution P is provided within a pickling tank 12 of the pickling device 11 and always circulates to offer high-temperature pickling and, at the same time, to prevent the pickling solution P from fuming.

A washing/drier section 13 (details not shown) is provided in the rear of the pickling tank 12 to wash the as-pickled strip with water and to dry the washed strip. Pickling in the pickling device 11 is carried out by a dip pickling method, and sulfuric acid and fluoronitric acid are used in the pickling solution P. A spray method may be used on the downstream side in the pickling tank 12 in order to facilitate the regulation of the pickling time.

The pickled, washed and dried strip 1S discharged from the pickling device 11 is passed through the pinch rolls 14 on the outlet side of the pickling device 11 into a trimmer 15 where side edge portions of the strip is trimmed. A heater (edge heater) 16 for heating the shear plane of the trimmed strip is provided downstream of the trimmer 15. The shear plane is heated at 900 to 1100° C. to remove strain created by work hardening.

Two coilers 17*a*, 17*b* are provided downstream of the heater, and the strip, of which the side edge portions have been heat-treated with the edge heater 16, is passed through pinch rolls 18*a*, 18*b* and coiled by means of the coilers. Just before the strip is coiled by a predetermined length, the strip being coiled is cut by means of the pinch roll 19 before the shear and the shear 20 to complete coiling of the strip by means of the coilers, thereby providing pickled coils 21*a*, 21*b*.

By virtue of the provision of the two coilers, upon completion of coiling by means of one coiler, the strip is coiled by means of the other coiler to permit continuous operation.

In the drawing, numeral 22 designates an atmosphere control cover 23 provided under the twin roll, and numeral 23 an atmosphere control cover before the hot rolling machine and an atmosphere control cover behind the hot rolling machine.

An apparatus shown in FIG. 2 will now be described.

Figure 2:
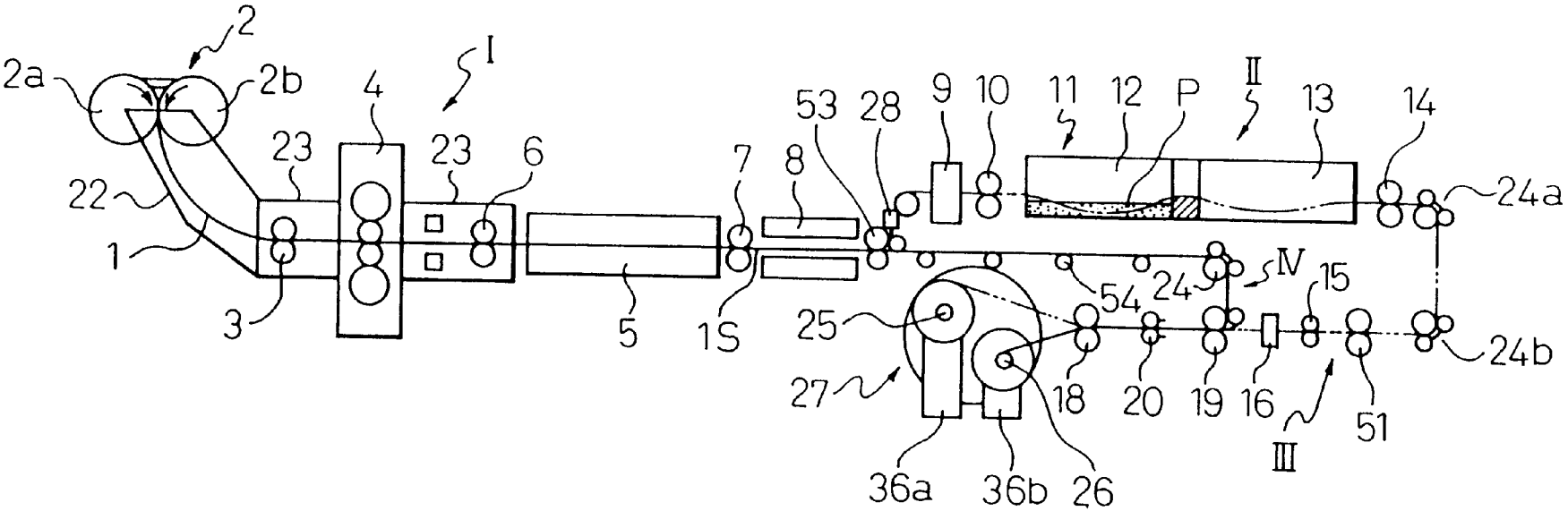
FIG. 2 is a schematic typical front view showing the apparatus for continuously casting a metallic coil according to another embodiment of the present invention.

FIG. 2 shows an apparatus wherein a continuous casting of a thin strip-like slab/hot rolling/heat treatment line I can be connected selectively to a pickling line II or a shear line IV.

Specifically, a shear line IV comprising: a feed roll 54 and a deflector roll 24, equipped with two snubber rolls and one guide, provided downstream of a cooler 8 provided on the outlet side of a heat-treating furnace 5 of the line I of continuous casting of a thin strip-like slab/hot rolling/heat treatment; and, disposed through the deflector roll, a pinch roll 19, before a shear, equipped with two snubber rolls and a guide, a shear 20, and a carousel type coiler 27 equipped with take-up reels 25, 26 serving both as a coiler and an uncoiler is provided. Further, a pickling line II comprising: a switchable vertical pass carrier device (vertical carrying device) 28 provided through pinch rolls 53 on the outlet side of the cooler 8; and a pickling device 11, a trimmer 15, an edge heater 16, and a shear 20 disposed through a mechanical descaling device 9 are provided in parallel with the shear line IV.

Therefore, the coiler is disposed below and in proximity to the pinch rolls 53 on the outlet side of the cooler, and the strip 1S is bent downward and horizontally respectively by the deflector rolls 24*a*, 24*b* each equipped with two snubber rolls and one guide, provided downstream of the pinch rolls 14 and then coiled alternately by two reels of the coiler.

The above two lines are designed so that, during suspension of the pickling line for repair or maintenance, the strip from the line of continuous casting of a thin strip-like slab/hot rolling/hot treatment may be introduced from the cooler 8 directly through the deflector roll 24 and the shear 20 into the take-up reels 25, 26 of the coiler 27 without passing through the pickling line, thereby coiling the strip.

Figure 3:
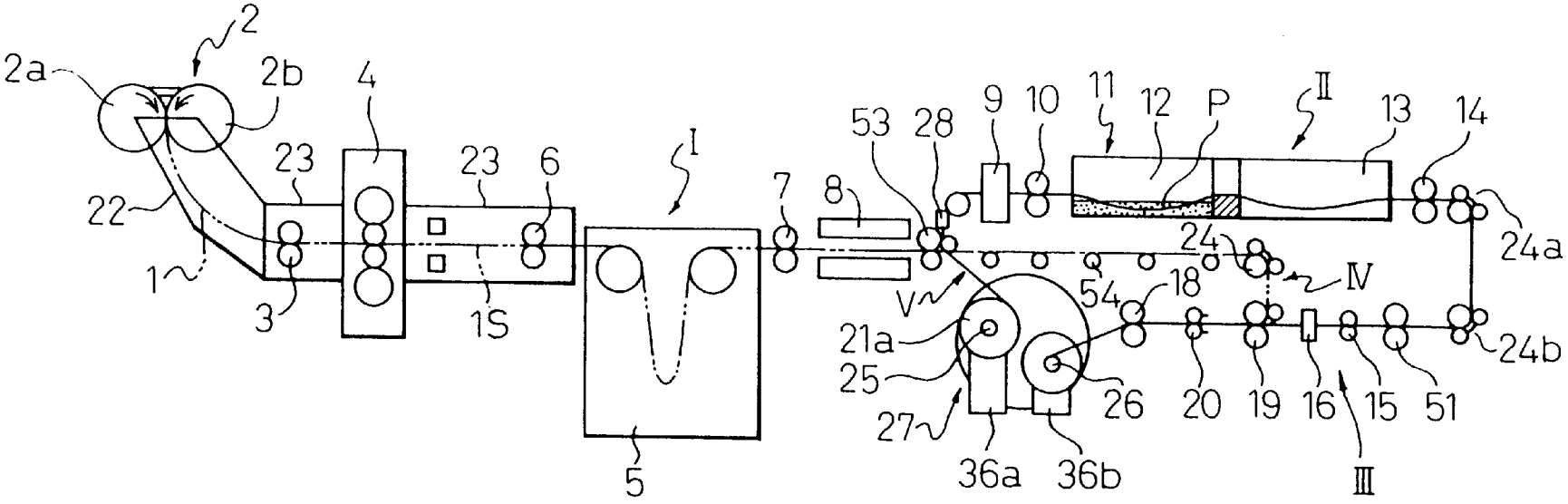
FIG. 3 is a schematic typical front view showing the apparatus for continuously casting a metallic coil according to a further embodiment of the present invention.

FIG. 3 shows an embodiment where, in the line shown in FIG. 2, the take-up reel 25 of the coiler 27 is used as an uncoiler.

Specifically, during suspension of the pickling line for repair or maintenance, a cooled strip is directly coiled by means of a take-up reel 25 through pinch rolls 53 provided on the outlet side of the cooler 8 to form a coil 21*a*. Thereafter, after the operation of the pickling line is resumed and during suspension of the line I of continuous casting of a thin strip-like slab/hot rolling/heat treatment, the coil 21*a* is uncoiled, and the strip is introduced through the pinch rolls 53 and the vertical pass carrier device 28 into the pickling line II and introduced through a pickling device, a trimmer, an edge heater, and a shear into the take-up reel 26 to coil the strip.

When both side edge portions of the strip is heat-treated by means of the edge heater 16, there is a fear of both the side edge portions of the strip being oxidized. A useful heat treatment method for avoiding such an unfavorable phenomenon is that the heat treatment is performed in a chamber with an inert gas sealed thereinto and covered with an inert gas and the chamber is cooled to 400° C. or below using an inert gas circulation type cooler (not shown).

Figure 4:
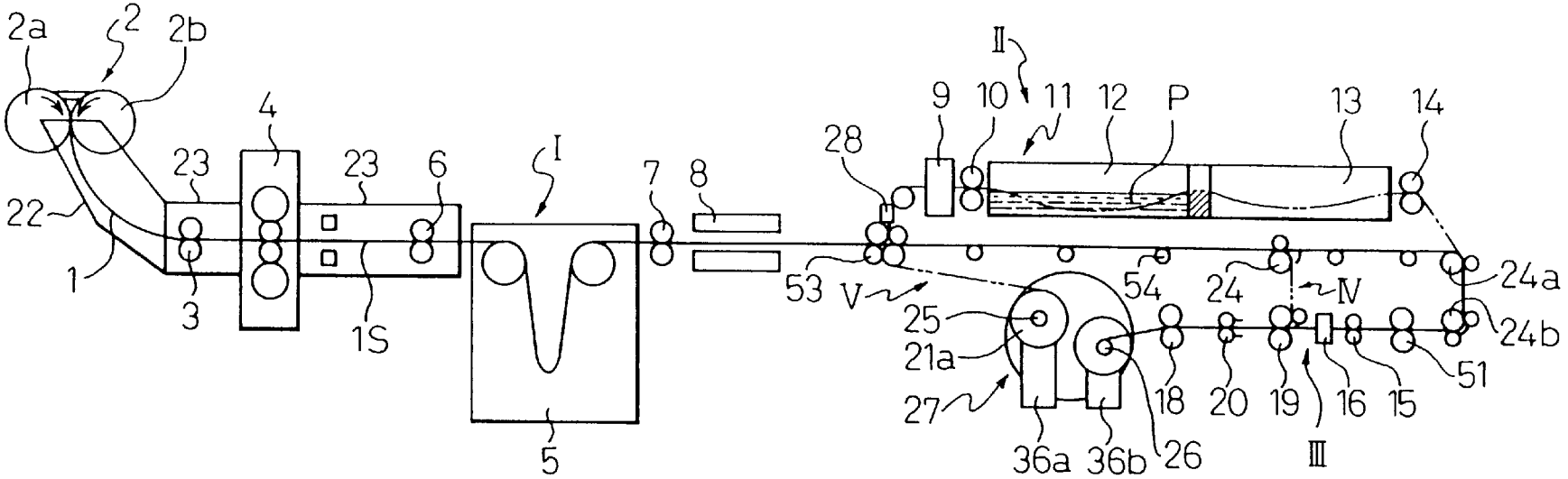
FIG. 4 is a schematic typical front view showing the system for continuously casting a metallic coil according to a yet further embodiment of the present invention.

FIG. 4 shows an embodiment where three lines, i.e., a shear line wherein a carousel type coiler is connected through a deflector roll, a trimmer line wherein a trimmer, a heat-treating device, a shear, and a coiler are provided, and a pickling line wherein a pickling device, a trimmer, a heat-treating device, a shear, and a coiler are connected through a vertical carrying device are provided, in parallel to one another, downstream of a heat-treating furnace in the line of continuous casting of a thin strip-like slab/hot rolling/heat treatment so that the three lines are switchable.

Specifically, a carousel type coiler 27 is connected through a carrier roll 54 and a deflector roll 24 equipped with one snubber roll and one guide, downstream of a cooler 8 in the line I of continuous casting of a thin strip-like slab/hot rolling/heat treatment to provide a shear line IV, and a pickling device 11, a trimmer 15, a heat-treating device (edge heater) 16, a shear 20, and a coiler 27 are connected through a vertical pass carrier device 28 to provide a pickling line II in parallel with the shear line IV.

Further, it is also possible to construct a trimmer line III. Specifically, the carrier roll 54 provided on the outlet side of the cooler 8 is extended, and a pinch roll 51, a trimmer 15, a pinch roll 19 equipped with a snubber roll and a guide, a shear 20, and a coiler 27 are connected through a deflector roll 24*a* (equipped with one snubber roll) and 24*b* (equipped with two snubber rolls and one guide) to provide a trimmer line III.

By virtue of the above construction, three lines, that is, a line wherein a thin strip-like slab is subjected to hot rolling and heat treatment and then coiled, a line wherein a thin strip-like slab is subjected to hot rolling and heat treatment and then subjected to pickling, trimming, heat treatment, and coiling, and a line wherein a thin strip-like slab is subjected to hot rolling and heat treatment and then subjected to trimming, heat treatment, and coiling, are switchable.

In general, there are various requirements for coils, often necessitating a change in steps. In the present invention, a suitable line can be selected according to these various requirements to change the steps, and various coils can be easily produced through continuous or discontinuous operation.

Further, when repair or maintenance is performed in a part of the lines, switching to a different line may be conducted to continue the operation. Therefore, there is no need to cease (or stop) all the lines, enabling the productivity on the whole line basis to be improved.

As with the embodiment shown in FIG. 3, this embodiment includes a carousel type coiler 27 equipped with take-up reels 25, 26 usable for both coiling and uncoiling purposes. When one take-up reel 25 is connected to the vertical pass carrier device 28, for example, the production system may be operated in such a manner that a coil 21*a*, which has been coiled by means of one take-up reel 25 through the line V of continuous casting of a thin strip-like slab/hot rolling/hot treatment/coiling, is uncoiled, introduced through the vertical pass carrier device 27, into the pickling/trimmer/heat treatment/coiling line II to conduct pickling, trimming and heat treatment, and then coiled by means of the other take-up reel 26. In this case, the pickling/trimmer/heat treatment/coiling line II can be operated independently of the continuous casting of a thin strip-like slab/hot rolling/hot treatment/coiling line.

Figure 5A:
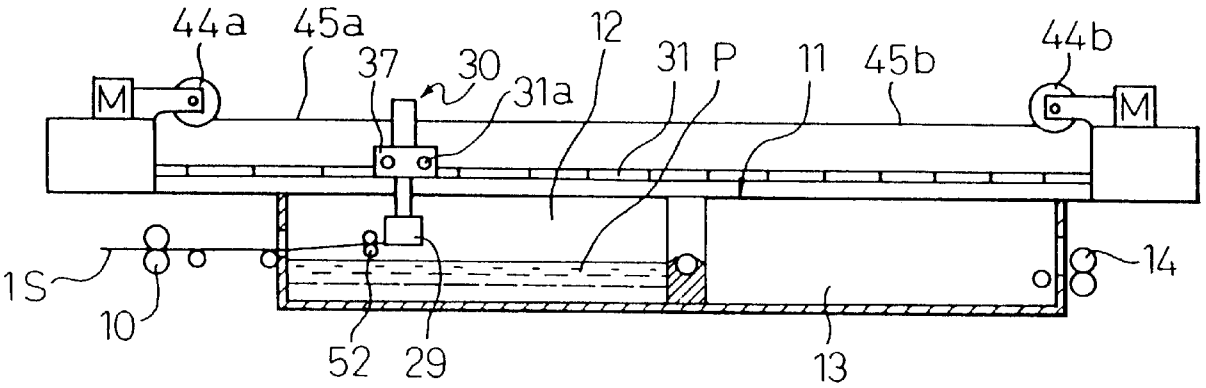
FIG. 5(A) is a schematic typical front view partly in section showing the state of movement, within the pickling tank, of a strip carrying device used in the present invention, for carrying a strip through a pickling tank, and FIG. 5(B) a schematic typical front view partly in section showing the state of movement of the above strip carrying device within a washing/drier section.

FIGS. 5(A) and (B) show an embodiment of a structure of a strip carrier device 30 which is equipped with a mechanism 29 for detaching a strip 1S and introducing the strip 1S into a pickling device 11 and movable over a pickling tank 12 and a washing/drier section 13.

Figure 5B:
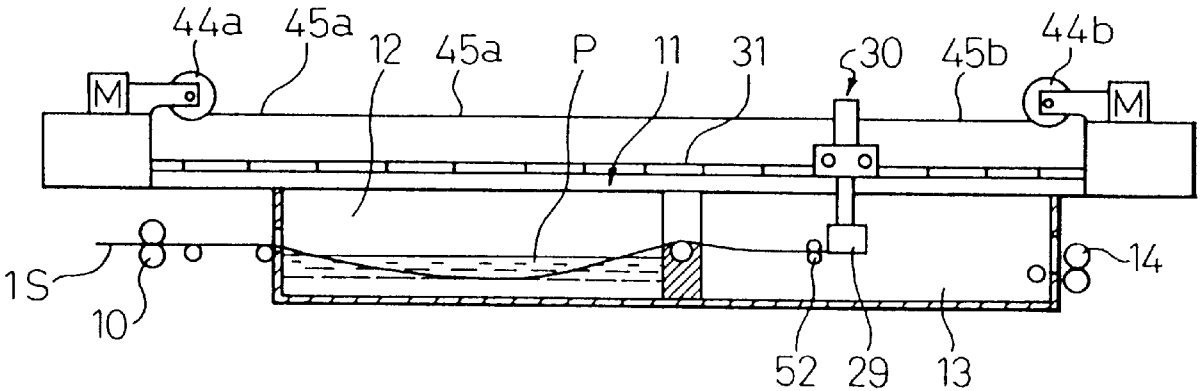

As shown mainly in FIGS. 2, 3, and 4, the strip carrier device 30, when a coil is subjected to pickling in discontinuous operation, functions to grasp the front end of a strip (or the front end of a dummy sheet), which, after coiling, has been uncoiled from, for example, a carousel type coiler 27 equipped with take-up reels 25, 26 serving both as a coiler and an uncoiler and introduced through the vertical pass carrier device 28 into the pickling tank 21, at the inlet of the pickling device as shown in FIG. 5(A) and to carry the strip to the outlet of the pickling device as shown in FIG. 5(B).

The strip carrier device 30 is provided so as to be movable on a guide rail 31, provided over the pickling device 11, through steel wires 45*a*, 45*b* by taking advantage of winches 44*a*, 44*b* each equipped with a drive M.

Figure 6B:
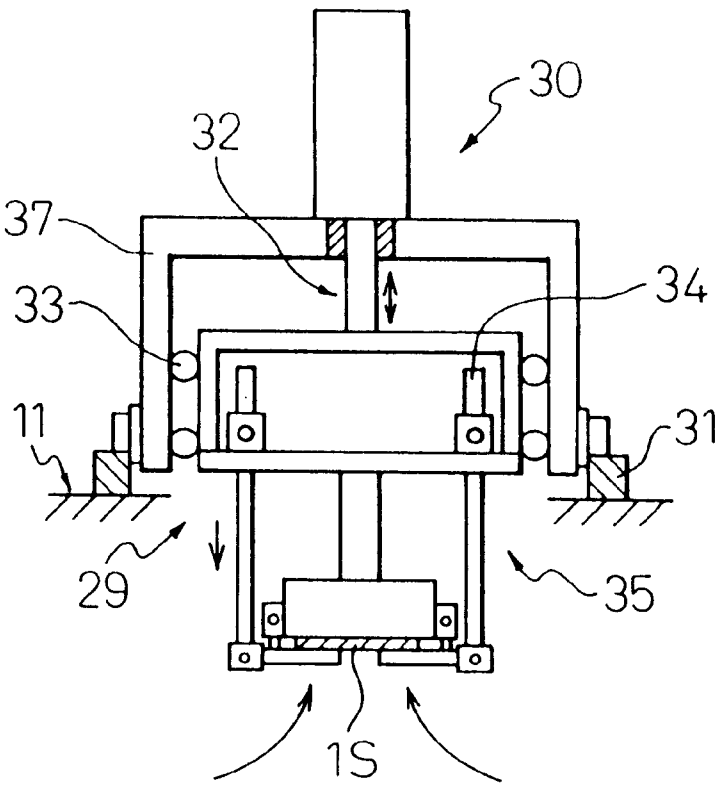
FIG. 6(A) is a schematic side view partly in section showing a strip carrying device used in the present invention, for carrying a strip through a pickling tank, with the strip being in a released state, and FIG. 6(B) a schematic side view partly in section showing the above strip carrier device with the strip being grasped thereby.
Figure 6A:
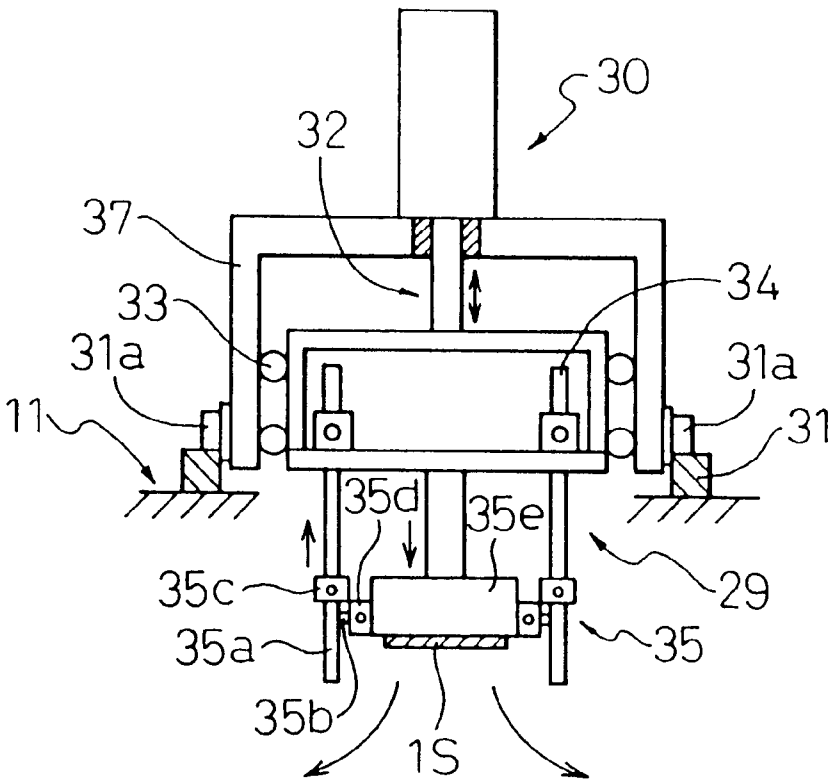

The detailed structure of the strip carrier device is shown in FIGS. 6(A) and (B). In the drawings, a strip carrier table 37 liftably suspends a detaching mechanism 29 guided by a guide wheel 33 using a lift actuator 32 provided on the strip carrier table.

The detaching mechanism 29 is provided with a manipulator 35 actuated by an actuator 34, and the front end 35*a* of the manipulator is constructed so as to be bendable inward through a bending portion 35*c*. The front end 35*a* is connected to a connecting member 35*b* which is rotatably provided at a bending portion 35*d* provided on the side portion of a strip pushing portion 35*e*.

When the strip carrier device 30 grasps the front end of the strip, as shown in FIG. 6(A), the strip carrier device 30 with the front end 35*a* of the manipulator being disengaged is positioned at the front end portion of the strip 1S, and the lift actuator 32 is descended to bring the strip pushing portion 35*e* in the detaching portion 29 into press contact with the strip 1S.

Then, as shown in FIG. 6(B), the manipulator 35 is lowered by means of the actuator 34, and the connecting member 35*b* is rotated to bend the front end 35*a* of the manipulator inward, thereby grasping the strip 1S.

When the front end of the strip is released, as shown in FIG. 6(A), the manipulator 35 is ascended, and the rotation of the connecting member 35*b* permits the manipulator 35*a* to be returned to the disengaged position, thereby releasing the front end of the strip.

According to the present invention, since the strip carrier device is provided so as to be movable within the pickling device, the coils can be moved one by one within the pickling tank.

Further, the carrying speed of the strip carrier device can also be controlled in such a manner that when the strip is grasped and released by the front end of the manipulator, the carrying speed is reduced, while when pickling and washing are conducted, the carrying speed is increased.

Figure 7:
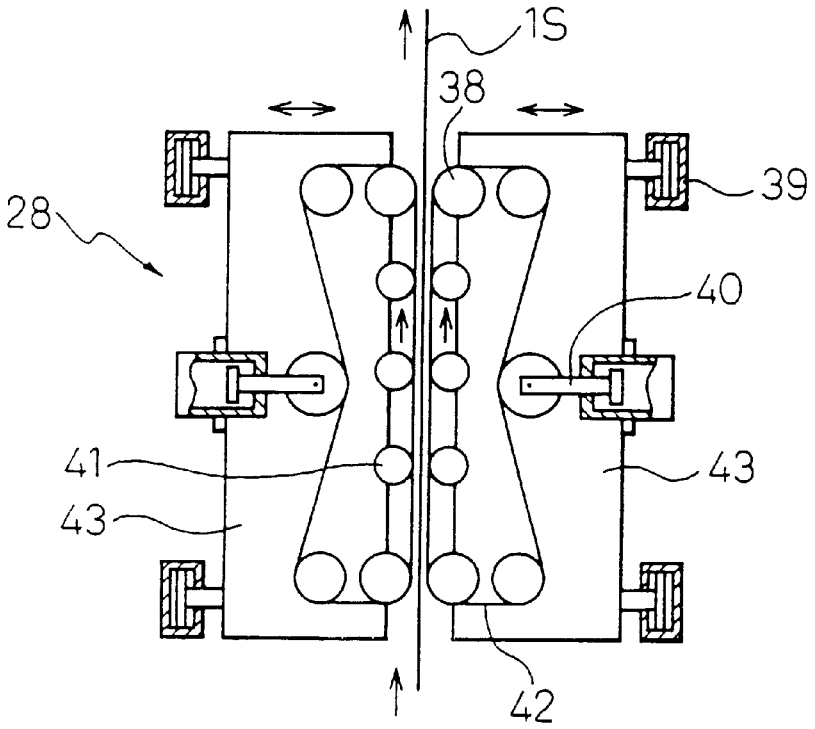
FIG. 7 is a schematic front view of a vertical pass carrier device used in the present invention.

FIG. 7 is an embodiment of the structure of a vertical pass carrier device 28.

FIG. 7 is a front view of the vertical pass carrier device, and a carrier unit pushing table 43 is provided on both surface sides of a strip 1S. A drive roller 38 and an idle roll 41 are rotatably provided on the pushing table 43. Further, a steel wire belt 42 is looped on the rolls. The pushing table 43 is moved in a reciprocative manner in the direction of the surface of the strip 1S by means of the carrier unit pushing actuator 35, and tension is applied also to the steel wire belt 42 by means of a belt tension controller 40 provided on the pushing table 43.

When the strip 1S is carried in the vertical direction, the carrier unit pushing table 43 is moved toward the strip 1S to push the steel belt 42 against the surface of the strip. Further, the belt tension controller 40 is driven to impart a predetermined tension to the steel wire belt 42. In such a state, the drive roller 38 is rotated to move the steel wire belts 42 in the vertical direction, causing the strip 1S sandwiched between the steel wire belts 42 to be carried in the vertical direction.

In a conventional process line, a rope or the like is usually passed through rolls corresponding to a path through which a strip is to be passed, and the strip is then guided into the line. In the present invention, it is also possible to pass the coils one by one in a batch process through the line.

Figure 8:
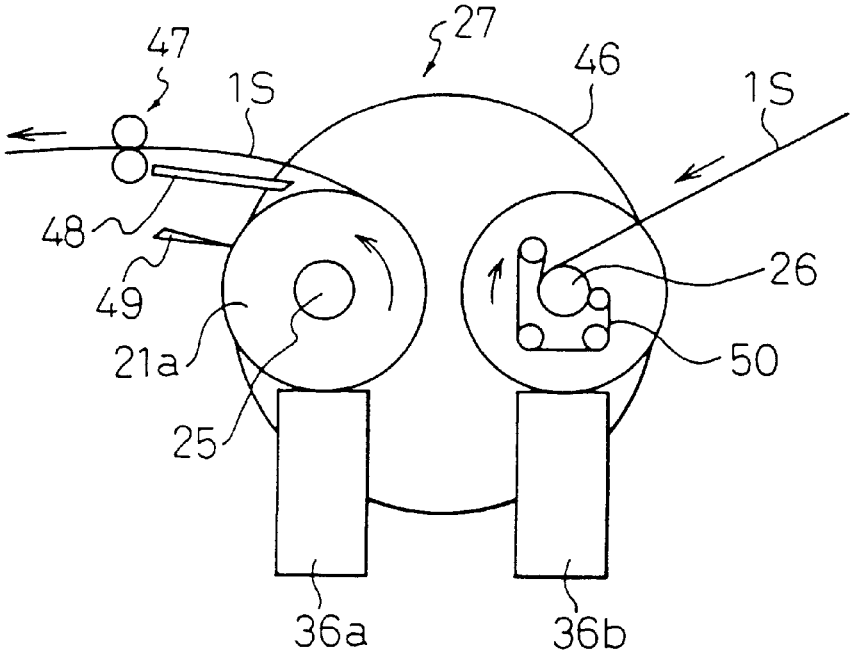
FIG. 8 is a schematic front view of a carousel type coiler used in the present invention.

FIG. 8 is an embodiment of a carousel type coiler equipped with two take-up reels usable for both coiling and uncoiling purposes.

A take-up reel 25 is used also as an unwinding reel, and a coil 21*a* coiled by means of a take-up reel 25 is uncoiled through an uncoiling pinch roll 47.

In uncoiling the strip, a band binding the coil 21*a* is cut with a band cutter 49, and the front end of the strip is guided by means of a guide chute 48 into between uncoiling pinch rolls 47 of the carousel type coiler 27 and fed into a pickling line.

In this case, the strip, which has been passed through the steps of pickling and trimming, is coiled by means of a take-up reel 26 with a revolution device 46 of the carousel type coiler 27 being stopped. Numeral 50 designates a belt wrapper.

The process for producing a metallic coil according to the present invention will be described.

At the outset, a thin strip-like slab having a thickness of not more than 6 mm is cast, for example, by means of a twin-roll type continuous casting machine. The resultant thin strip-like slab is hot-rolled with a reduction ratio of not less than 30% by taking advantage of heat possessed by the thin strip-like slab by means of a hot rolling machine connected directly to the casting machine, and the resultant hot-rolled strip is heat-treated in a heat-treating furnace connected directly to the hot rolling machine while holding the temperature with a heat retaining cover so as not to lower the temperature of the thin strip-like slab to 800° C. or below.

The heat treatment temperature is in the range of from 800 to 1250° C., preferably in the range of from 1100 to 1250° C. The strip discharged from the heat-treating furnace is transferred into a cooler where it is cooled from a cooling initiation temperature around 1000° C. to a temperature of 100° C. or below at a rate of 20 to 40° C./sec. The cooling serves to decrease the amount of a scale created on the surface of the strip and, at the same time, to prevent intergranular corrosion, thus preventing excessive pickling attributable to intergranular corrosion.

Subsequently, the cooled strip is introduced into a pickling device and immersed in a pickling solution contained in a pickling tank. The pickling solution contained in the pickling tank is at a temperature just below 100° C., and pickling at such a high temperature can improve the pickling reaction rate, enabling the pickling time to be shortened to 40 sec or less. After the completion of the pickling, the strip is washed with water and dried and discharged from the pickling device, and both side edge portions of the strip is trimmed with a side trimmer. Then, the strip is passed through a heat-treating device where the shear plane of the strip is heated in the range of from 900 to 1100° C. to remove strain created by work hardening, of the shear plane of the strip, caused by the side trimmer.

When the shear strain has been removed, breaking of the strip attributable to the shear strain can be prevented at the time of, for example, cold rolling or cold working of the strip.

Side edge portions of a strip prepared by continuously casting a thin strip-like slab by means of a twin-roll type continuous casting machine and hot-rolling the thin strip-like slab conducted by the present invention have a disordered shape and are uneven, and when the hot-rolled strip as such is cold-rolled with a high reduction ratio under high tension, there is a possibility that cracks are created with the uneven portions serving as an origin of the cracks, resulting in breaking of the strip. In the present invention, after the side edge portions of the strip are trimmed, the shear strain created by work hardening due to trimming is removed by heat treatment, thereby avoiding the above unfavorable phenomenon.

The strip is then passed through a shear where cutting of front and rear ends of the strip or cutting of the strip in the widthwise direction thereof for the purpose of providing the necessary quantity of the coil is performed. The coil is then coiled by a take-up reel.

Further, according to the present invention, besides the above embodiment wherein a pickling line is connected to the heat treatment line, that is, the line of continuous casting of a thin strip-like slab/hot rolling/heat treatment, it is also possible to use an embodiment where the trimmer line or the shear line is connected to the above heat treatment line.

Specifically, a vertical pass carrier device for switching the strip carrier line is provided on the outlet side of the cooler, and, in addition, a coil car is provided for each of the two take-up reels serving for both coiling and uncoiling purposes, such as in a carousel type coiler, to permit the coil to be delivered and received, thus enabling two to three series of lines to be operated independently of one another.

Therefore, according to the process of the present invention, in the case of suspension of the casting, hot rolling, heat treatment or pickling device for repair, for example, when only the device for continuously producing a thin strip-like slab can be operated, or alternatively when only the pickling and trimmer devices can be operated, the line pass may be switched to conduct the change of steps, thereby producing a treated coil.

EXAMPLE

A continuous casting/hot rolling/heat treatment/pickling device shown in FIG. 1 was provided. At the outset, a thin strip-like slab of stainless steel, having a thickness of 2 to 4 mm and a width of 800 to 1300 mm was continuously cast at a rate of 30 to 150 m/min, and the thin strip-like slab of stainless steel having a temperature of 1200° C. was hot-rolled with a reduction ratio of not less than 30% to prepare a stainless steel strip having a thickness of 1.5 to 2.7 mm. The strip was then passed through a heat-treating furnace where it was heat-treated at 1100 to 1250° C. for 4 to 10 sec. The heat-treated strip was then cooled to 100° C. at a rate of 50° C./sec. The cooled strip was then shot-blasted and then introduced into a pickling tank, containing a pickling solution of sulfuric acid and fluoronitric acid, where pickling was performed under conditions of pickling solution temperature 70° C. and immersion time 30 sec. The pickled strip was then washed and dried in a washing/drying section. The dried strip was passed through a trimmer. The shear plane was heat-treated by means of an edge heater in an inert atmosphere of 900 to 1100° C., and the strip was then cooled and coiled by means of a coiler to produce a pickled coil.

The pickled coil thus obtained had good surface appearance, no cracks, an even internal texture and no fear of intergranular corrosion, that is, a stable structure, demonstrating that it had a good quality. Further, as compared with the conventional off-line pickling, the handling cost for pickling can be greatly reduced and, at the same time, the pickling time can be greatly shortened.

A main object of the present invention is to connect a pickling/trimmer/heat treatment line to a continuous casting of a thin strip-like slab/hot rolling/heat treatment process, thereby realizing a continuous operation of continuous casting of a thin strip-like slab/hot rolling/heat treatment/pickling/trimmer/heat treatment. However, the present invention aims also to minimize cease (or stop) of the whole line for repair or maintenance of the line and, when different treatment steps are required, to provide a plurality of switchable lines, which permit various combinations of steps, thereby widening the range of combinations of treatment steps.

It should be noted that the present invention is not limited to the above embodiments and the type, structure, mechanism, number, dimension, configuration, operating conditions, etc. regarding elements constituting devices and apparatus necessary for constructing the present invention may be varied and modified depending upon materials used, operating conditions, etc. so far as such variations and modifications meet the construction of the present invention defined in the claims.

Steel materials usable in the present invention include common steels, stainless steels, electromagnetic steels, and other steels such as special steels.

Industrial Applicability

In the present invention, a pickling device and a trimmer are provided in direct connection with a line for continuous casting of a thin strip-like slab/hot rolling/heat treatment, contributing to a reduction in cost of the steps of pickling and trimming and shortening of the period for delivery. Further, a line of continuous casting of a thin strip-like slab/hot rolling/heat treatment and a pickling line, a trimmer line, or a shear line can be operated in a switchable manner. Therefore, there is no need to cease (or stop) the whole series of lines for reasons of repair or maintenance of each step, enabling the prevention of a lowering in productivity and the prevention of an increase in the quantity of coil in process and the stock of coil.

In general, there are various requirements for coils, often necessitating the change of steps. In the present invention, a suitable line can be selected according to these various requirements to change the steps, and various coils can be easily produced through continuous or discontinuous operation.

Therefore, the production of a metallic coil according to the present invention is very advantageous from the viewpoint of industry.

We claim:

1. A system for continuously producing a metallic coil from a thin strip-like slab, comprising:

a device for continuously casting a thin strip-like slab; a hot rolling machine for hot rolling the thin strip-like slab cast by the device into a strip; a heat-treating furnace for heat-treating the strip rolled by the hot rolling machine; a cooler for cooling the strip heat-treated in the heat-treating furnace; a pinch roll provided in proximity to the exit side of the cooler; a vertical carrying device downstream said pinch roll for carrying the strip cooled in the cooler in a vertical direction; a feed roll forming a transfer line extending downstream of said pinch roll; with said vertical carrying device being located above said pinch roll and branching the transfer line; a pickling device downstream said vertical carrying device for pickling the cooled strip carried by the vertical carrying device; a side trimmer located downstream both said feed roll and said pickling device for trimming both side edge portions of the strip; a width shear located downstream both said feed roll and said side trimmer for cutting the strip in the widthwise direction thereof; and a coiler located downstream both said pinch roll and said width shear, said coiler having two take-up reels at least one of which serves both as a coiler and an uncoiler, said coiler being located in proximity to the vertical carrying device;

the system having the following three lines:

(a) a pickling line comprising in sequence said vertical carrying device, said pickling device, a first deflector roll device arranged downstream of said pickling device, said side trimmer, said width shear and said coiler;

(b) a width shear line comprising in sequence said feed roll, a second deflector roll device arranged downstream of said feed roll, said width shear and said coiler; and (c) a side trimmer line comprising in sequence said feed roll, said side trimmer, said width shear and said coiler.

2. The system according to claim 1, wherein a device for heat-treating a shear plane of the side-trimmed strip is further provided downstream of the side trimmer.

3. The system according to claim 1, wherein a strip carrying device for transferring the cooled strip through said pickling device, while grasping the front end of the cooled strip, to immerse the cooled strip into a pickling solution is further provided in conjunction with the pickling device.

4. The system according to claim 1, wherein the vertical carrying device comprises a steel wire belt pressed in contact with both sides of the cooled strip and a drive roller for driving the steel wire belt.

5. The system according to claim 1, wherein covers for controlling atmosphere are provided downstream of the device for continuously casting a thin strip-like slab, and upstream and downstream of the hot rolling machine, respectively.

* * * * *